US006867738B2

(12) United States Patent
Birnbaum et al.

(10) Patent No.: US 6,867,738 B2
(45) Date of Patent: Mar. 15, 2005

(54) RECESSED APERTURE-COUPLED PATCH ANTENNA WITH MULTIPLE DIELECTRICS FOR WIRELESS APPLICATIONS

(75) Inventors: Thomas J. Birnbaum, Santa Cruz, CA (US); Stephen C. Fenwick, Mountain View, CA (US); Arthur W. Astrin, Palo Alto, CA (US); Ricardo Mariano, Hayward, CA (US)

(73) Assignee: Apple Computer, Inc., Cupertino, CA (US)

( * ) Notice: Subject to any disclaimer, the term of this patent is extended or adjusted under 35 U.S.C. 154(b) by 0 days.

(21) Appl. No.: 10/309,499

(22) Filed: Dec. 3, 2002

(65) Prior Publication Data

US 2003/0117323 A1 Jun. 26, 2003

Related U.S. Application Data

(63) Continuation of application No. 09/775,859, filed on Feb. 1, 2001, now Pat. No. 6,496,149.

(51) Int. Cl.[7] ..... H01Q 1/24

(52) U.S. Cl. ..... 343/702; 343/700 MS; 455/90

(58) Field of Search ..... 343/700 MS, 702, 343/841, 846, 872; 455/90, 271, 89

(56) References Cited

U.S. PATENT DOCUMENTS

| | | | | | |
|---|---|---|---|---|---|
| 5,657,028 | A | * | 8/1997 | Sanad | 343/700 MS |
| 6,236,366 | B1 | * | 5/2001 | Yamamoto et al. | 343/700 MS |
| 6,259,933 | B1 | * | 7/2001 | Bambridge et al. | 455/557 |
| 6,285,328 | B1 | * | 9/2001 | Masaki et al. | 343/702 |
| 6,295,031 | B1 | * | 9/2001 | Wallace et al. | 343/702 |
| 6,346,916 | B1 | * | 2/2002 | Odachi et al. | 343/702 |
| 6,362,786 | B1 | * | 3/2002 | Asano et al. | 343/700 MS |
| 6,531,985 | B1 | * | 3/2003 | Jones et al. | 343/702 |
| 6,642,892 | B2 | * | 11/2003 | Masaki et al. | 343/702 |

* cited by examiner

*Primary Examiner*—Tho Phan
(74) *Attorney, Agent, or Firm*—Blakely, Sokoloff, Taylor & Zafman LLP

(57) ABSTRACT

The present invention provides an aperture-fed patch antenna assembly that is recessed into a conductive surface of an external shell of an electronic device. In one embodiment, an antenna feed attached to a removable core of the electronic device may be removed from the external shell without requiring a manual disconnecting of the antenna feed from a wireless radio modem in the electronic device. The patch antenna assembly includes a shim having an aperture therein and positioned between a primary dielectric and a printed circuit board to create a secondary dielectric between the primary dielectric and the printed circuit board. In one embodiment, the primary dielectric is ceramic and the shim is plastic.

19 Claims, 3 Drawing Sheets

RECESSED APERTURE-COUPLED PATCH ANTENNA WITH MULTIPLE DIELECTRICS FOR WIRELESS APPLICATIONS

This application is a continuation application of co-pending U.S. patent application Ser. No. 09/775,859, filed Feb. 1, 2001 U.S. Pat. No. 6,496,149.

FIELD OF THE INVENTION

The field of the invention relates to antennas, and particularly to patch antennas recessed within housings of electronic devices such as computers.

BACKGROUND OF THE INVENTION

Patch antennas, also called microstrip patch antennas, are common in the art. A exemplary patch antenna may include a transmission line feed, multiple dielectrics, and a metallized patch on one of the dielectrics. Conventional patch antennas are directly coupled to their feeds by coaxial cables.

When conventional patch antennas are used in electronic devices two disadvantages result. First, the coaxial cable connection requires manual disassembly if the antenna or the element to which the antenna is affixed or incorporated is extracted from the electronic device. Second, the patch antenna assembly often noticeably protrudes from the housing of the electronic device and detracts from the device's cosmetic appearance.

A solution is needed that provides a patch antenna assembly that is easily extracted from its feed with minimal or no disassembly by the user. Additionally, the patch antenna assembly should be capable of being virtually hidden within an external housing of an electronic device.

SUMMARY OF THE INVENTION

The present invention provides an aperture-fed patch antenna assembly that is recessed into a conductive surface of an external shell of an electronic device. In one embodiment, an antenna feed attached to a removable core of the electronic device may be removed from the external shell without requiring a manual disconnecting of the antenna feed from a wireless radio modem in the electronic device. The patch antenna assembly includes a shim having an aperture therein and positioned between a primary dielectric and a printed circuit board to create a secondary dielectric between the primary dielectric and the printed circuit board. In one embodiment, the primary dielectric is ceramic and the shim is plastic.

BRIEF DESCRIPTION OF THE DRAWINGS

The present invention is illustrated by way of example and not limitation in the figures of the accompanying drawings, in which.

DETAILED DESCRIPTION

A recessed aperture-coupled patch antenna assembly is disclosed. In the following detailed description, numerous specific details are set forth in order to provide a thorough understanding of the present invention. However, it will be apparent to one of ordinary skill in the art that these specific details need not be used to practice the present invention. In some circumstances, well-known structures and materials have not been shown or described in detail in order not to unnecessarily obscure the present invention.

Figure 1A:
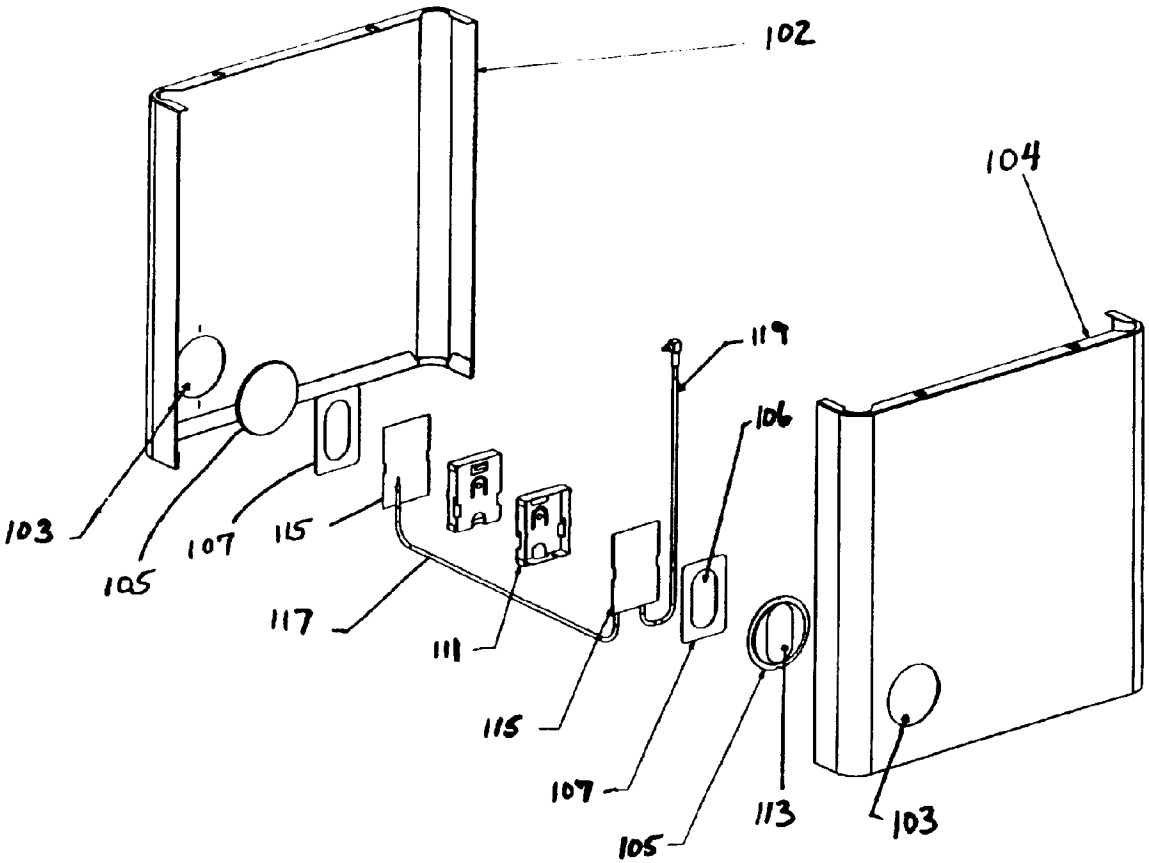
FIG. 1*a* is an exploded perspective view of a recessed patch antenna assembly according to one embodiment of the invention.

Referring now to FIG. 1*a*, an exploded perspective view of a patch antenna assembly is shown. Two opposing panels 102 and 104 of four-sided chassis (not shown) are illustrated. The remaining two panels have been omitted from FIG. 1*a* to show the various components of the patch antenna assembly. Panels 102 and 104 contain openings 103 for the ceramic antenna dielectrics 105, which support antennas 113 (metallized layers on ceramic antenna dielectrics 105). In one embodiment, the metallization forming the antennas 113 is aluminum, but other similar metals may be used. Shims 107 contain openings 106 to form an air gap and have front sides and back sides. The front sides of shims 107 are coupled to the antenna dielectrics 105, and the back sides of shims 107 are coupled to printed circuit boards 115 to create secondary dielectrics between the printed circuit boards 115 and antenna dielectrics 105. Shields 111 are coupled with printed circuit boards 115 to shield the printed circuit boards from internal electromagnetic interference (EMI). Additionally, the printed circuit boards 115 containing transmission antennas (not shown) are coupled together using coaxial cable 117. Another coaxial cable 119, coupled with one of the printed circuit boards 115 couples the circuit boards to a radio modem (not shown) installed in a removable core (not shown) of the electronic device.

Figure 1B:
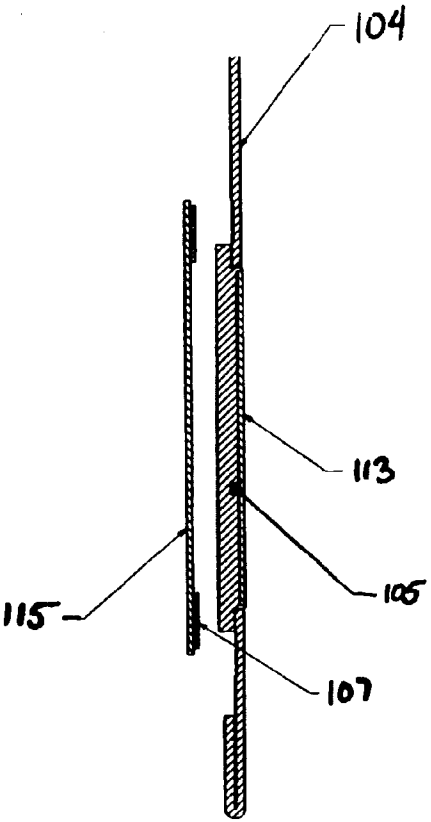
FIG. 1*b* is a side view of a recessed patch antenna assembly according to one embodiment of the invention.

FIG. 1*b* is a side view of panel 104 illustrating a recessed patch antenna according to one aspect of the invention. In FIG. 1*b*, antenna dielectric 105 is positioned within an opening in chassis 104 such that antenna 113 is substantially coplanar with the exterior surface of panel 104. A printed circuit board assembly (not shown) may be coupled with shim 107, which is positioned adjacent to the backside of antenna dielectric 105.

When shim 107 is placed between the printed circuit board assembly (not shown) and antenna dielectric 105, the aperture 106 in shim 107 creates an air gap, which serves as a secondary dielectric. Shim 107 ensures that the distance between printed circuit board 115 and antenna dielectric 105 is optimal for effective antenna operation. If shim 107 is not provided, it is difficult to maintain the optimal distance within economically manufacturable tolerances. Additionally, in one embodiment, shim 107 prevents antenna dielectric 105 from touching printed circuit board 115. In another embodiment, where the antenna feed is not a printed circuit board, the shim 107 prevents antenna dielectric 105 from touching the antenna feed.

Referring again to the embodiment illustratively shown in FIG. 1*a*, an air gap is formed between antenna dielectric 105 and printed circuit board 115 by aperture 106 in shim 107. Because the air gap serves as a secondary dielectric, the depth of the air gap is critical to the tuning of the antenna. In one embodiment, the depth of the air gap corresponds to the thickness of shim 107, which may be used to maintain the air gap at an optimal distance and to prevent direct (and potentially damaging) contact between the ceramic disk 105 and the printed circuit board 115. The optimal distance between printed circuit board 115 and antenna dielectric 105 varies according to the type of material used in the primary dielectric and according to the particular frequency used. For example, the optional distance may range from approximately 0.5 mm to approximately 4.0 mm in the 2.5 GHz frequency range. However, this range will vary depending upon the actual frequency, the configuration, and operating conditions used. Once determined the optimal distance should be maintained within a narrow +/− tolerance, illustratively, and not by way of limitation, approximately +/−0.25 mm in the 2.5 GHz frequency range. The exact amount of tolerance is driven by the ratio of the thickness of antenna dielectric 105 to the thickness of the air gap and the dielectric constant of the dielectric. For example, using polycarbonate instead of ceramic to form the antenna dielectric may change the optimal distance changes and the +/− tolerances, because polycarbonate has a constant different from the dielectric constant of ceramic. In other embodiments, the antenna dielectric may be made of other materials such as plastic and fiberglass, but use of these other materials will also change the optimal distance and the +/− tolerances.

In the embodiment shown in FIG. 1*a*, positioning antenna dielectrics 105 on opposite sides of the chassis (not shown) introduces directionality in the antennas 113. However, the antennas 113 are carefully chosen to be well suited for this directionality; and the diversity in the antenna set enables the antennas 113 to cover the entire space around the chassis. Although two antennas 113 are illustratively shown in FIG. 1*a*, another embodiment of the invention may include only a single recessed patch antenna assembly or may include more than two recessed patch antenna assemblies.

Figure 2:
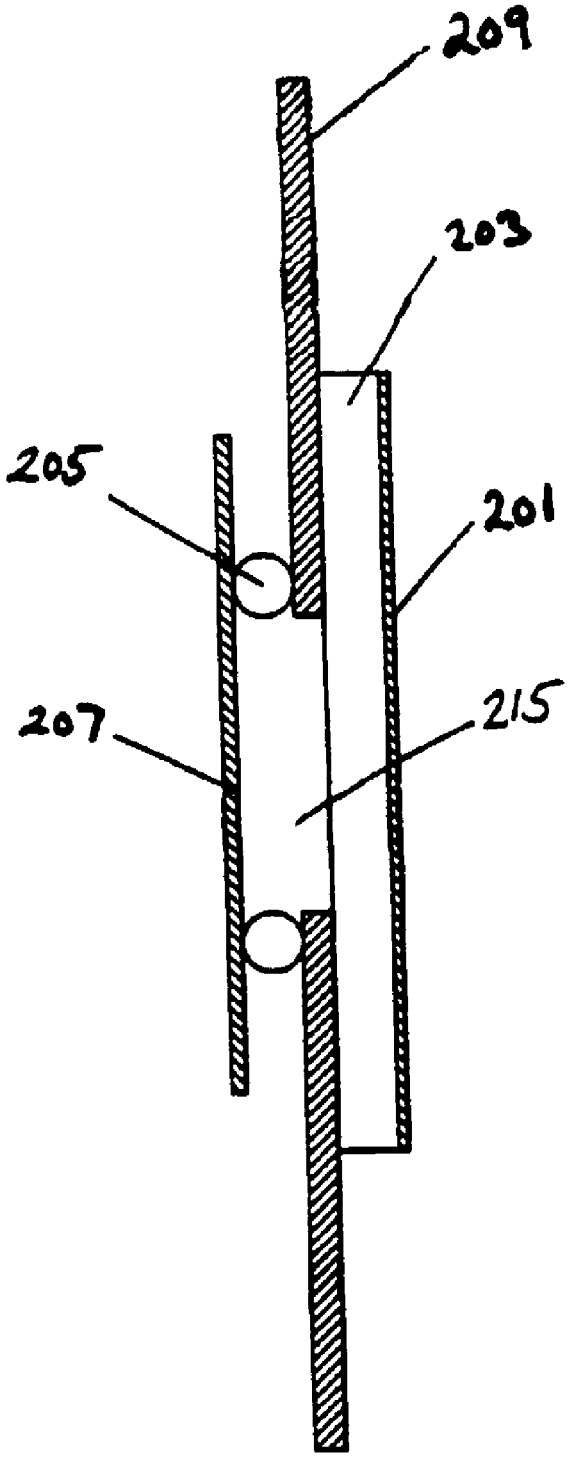
FIG. 2 is a side view a patch antenna assembly coupled with a removable antenna feed according to another aspect of the invention.

FIG. 2 illustrates a side view of a patch antenna assembly according to another embodiment of the invention, in which an antenna 201 is positioned on the exterior of a ground plane. In this embodiment, antenna 201 coupled with an outer surface of antenna dielectric 203. The inner surface of dielectric 203 spans an opening in a ground plane 209, which may be a conductive surface on an external shell of an electronic device. Shim 205 positioned on the interior side of the ground plane maintain an antenna feed 207, such as a printed circuit board containing a transmission line antenna, at an optimal distance from dielectric 203 by forming an air gap 215 between antenna dielectric 203 and antenna feed 207. In this embodiment, antenna 201 and/or at least a portion of dielectric 203 protrude past the exterior surface of ground plane 209. This embodiment, like that of FIG. 1, permits a core of the electronic device (not shown) to be removed from the external shell (ground plane) without disconnecting the antenna feed from a radio modem installed in the electronic device. In one embodiment, antenna dielectric may be mounted within a recessed area formed in the outer surface of ground plane 209. This recessed area may, in another embodiment, have a depth approximately equal to the combined thickness of antenna dielectric 203 and antenna 201, such that the exterior surface of antenna 201 is substantially co-planar with the exterior surface of ground plane 209.

In one embodiment, the present invention provides a patch antenna that uses an aperture feed. The antenna assembly includes a printed circuit board having a transmission line as a feed, and a diversity switch; a ceramic disk as a primary dielectric; an air gap between the printed circuit board and the ceramic disk as a secondary dielectric; a shim with an opening to control the depth of the air gap; and a metallized patch on one side of the ceramic disk. In this embodiment, the metallized patch serves as an antenna, the printed circuit board serves as the antenna feed, and connection between the two is made by proximity alone. Although illustratively shown as a printed circuit board, the antenna feed does not have to be fabricated as a printed circuit board.

In one embodiment, the assembly is recessed into the conductive surface (Faraday/EMI cage) of the housing (external shell) of an electronic device, such as a computer, which includes an internal core. This core, to which is attached the printed circuit board with transmission line antenna, is removable from the external shell. The ceramic disk with metallized patch is attached to this external shell. Further cosmetic treatment is used to camouflage the metallized patch and underlying antenna dielectric to provide a virtually hidden antenna for wireless communications. This embodiment allows the external shell to be removed from the computer core without disconnecting the antenna from the wireless radio modem in the product.

In one embodiment, the antenna may transmit and receive radio waves in about the 2.5 GHz range to enable wireless communications.

Although the present invention is described herein with reference to a specific preferred embodiment, many modifications and variations therein will readily occur to those with ordinary skill in the art. Accordingly, all such variations and modifications are included within the intended scope of the present invention as defined by the following claims.

What is claimed is:

1. A computer, the computer having an external shell and a patch antenna assembly positioned adjacent to the external shell, the patch antenna assembly comprising:

a primary dielectric adjacent to the external shell;

a metallized patch attached to a first side of the primary dielectric, wherein the metallized patch is an antenna;

a shim having a first side and a second opposite side, the first side of the shim positioned proximate a second side of the primary dielectric, the shim having an aperture therein to form a secondary dielectric; and an antenna feed removably positioned proximate the second side of the shim and coupled to the primary dielectric via the secondary dielectric to transmit a signal from the antenna feed to the primary dielectric.

2. The computer of claim 1, wherein the antenna feed is attached to a removable core removably positioned within an interior of the external shell.

3. The computer of claim 2, wherein the antenna feed is coupled to a radio modem attached to the removable core and wherein the external shell includes a conductive surface which provides an electromagnetic interface (EMI) cage which is grounded.

4. The computer of claim 1, wherein the secondary dielectric is an air gap.

5. An apparatus for wireless communication, comprising:

an electronic device having an external shell, the external shell having at least two opposing sides enclosing a hollow space therebetween;

a removable core to which a plurality of electrical components are attached, the removable core operatively and removably positioned within the hollow space, wherein one of the plurality of the electrical components is a radio modem;

an antenna feed attached to a side of the removable core and coupled to the radio modem;

a primary dielectric adjacent to one of the opposing sides of the external shell, the primary dielectric positioned such that the antenna feed is proximate the primary dielectric when the removable core is operatively and removably positioned within the hollow space;

a metallized patch attached to the primary dielectric, wherein the patch is an antenna; and a shim positioned between the primary dielectric and the antenna feed, the shim having an aperture therein to form a secondary dielectric between the antenna feed and the primary dielectric when the antenna feed is positioned proximate to the primary dielectric, a signal to be transmitted from the antenna feed to the primary dielectric via the secondary dielectric.

6. The apparatus of claim 5, wherein the electronic device is a computer and wherein the external shell includes a conductive surface which provides an electromagnetic interface (EMI) cage which is grounded.

7. The apparatus of claim 5, wherein the antenna feed is a line antenna operatively associated with a printed circuit board.

8. The apparatus of claim 5, wherein the primary dielectric is ceramic.

9. The apparatus of claim 5, wherein the secondary dielectric is an air gap.

10. The apparatus of claim 5, wherein the shim is plastic.

11. The apparatus of claim 10, wherein the shim maintains an optimal distance between the antenna feed and the primary dielectric.

12. The apparatus of claim 5, further comprising:

a second antenna feed attached to the removable core on a side opposite the side of the removable core to which the antenna feed is attached;

a second primary dielectric adjacent to the other of the opposing sides of the external shell, the second primary dielectric positioned such that the second antenna feed is proximate the second primary dielectric when the removable core is operatively and removably positioned within the hollow space;

a second metallized patch attached to the second primary dielectric, wherein the second metallized patch is a second antenna; and a second shim positioned between the second primary dielectric and the second antenna feed, the second shim having an aperture therein to form a second secondary dielectric between the second antenna feed and the second primary dielectric when the second antenna feed is positioned proximate the second primary dielectric, a signal to be transmitted from the antenna feed to the primary dielectric via the secondary dielectric.

13. The apparatus of claim 12, wherein the second shim is plastic.

14. The apparatus of claim 12, wherein the positioning of the primary dielectric and second primary dielectric in opposite sides of the external shell enables the antennas to cover a space surrounding the external shell.

15. A computer, the computer having an external shell and a patch antenna assembly positioned adjacent to the external shell, the patch antenna assembly comprising:

a dielectric adjacent to the external shell;

a metallized patch attached to a first side of the dielectric and positioned in an aperture in the external shell, wherein the metallized patch is an antenna and the aperture comprises a hole through the external shell; and an antenna feed removably positioned proximate the dielectric to transmit a signal from the antenna feed to the dielectric, wherein the antenna feed is coupled to the metallized patch without a wired connection;

wherein the external shell includes a conductive surface which provides an electromagnetic interface (EMI) cage which is grounded.

16. A computer, the computer having an external shell and a patch antenna assembly positioned adjacent to the external shell, the patch antenna assembly comprising:

a dielectric adjacent to the external shell;

a metallized patch attached to a first side of the dielectric and positioned in an aperture in the external shell, wherein the metallized patch is an antenna; and an antenna feed removably positioned proximate the dielectric to transmit a signal from the antenna feed to the dielectric, wherein the antenna feed is coupled to the metallized patch without a wired connection;

wherein the external shell includes a conductive surface which provides an electromagnetic interface (EMI) cage which is grounded, and wherein the antenna feed is attached to a removable core removably positioned within an interior of the external shell.

17. The computer of claim 16, wherein the antenna feed is coupled to a radio modem attached to the removable core.

18. The computer of claim 16, further comprising:

a shim positioned between the dielectric and the antenna feed, the shim having an aperture therein to form a secondary dielectric between the antenna feed and the dielectric when the antenna feed is positioned proximate to the dielectric, a signal to be transmitted from the antenna feed to the dielectric via the secondary dielectric.

19. The computer of claim 18, wherein the secondary dielectric is an air gap.

* * * * *